United States Patent [19]

Sakurai et al.

[11] Patent Number: 4,833,370

[45] Date of Patent: May 23, 1989

[54] ELECTRON BEAM DEFLECTOR

[75] Inventors: Soichi Sakurai, Yokohama; Michitaka Osawa, Fujisawa; Hiroki Oguro, Yokohama, all of Japan

[73] Assignee: Hitachi, Ltd., Tokyo, Japan

[21] Appl. No.: 252,542

[22] Filed: Oct. 3, 1988

[30] Foreign Application Priority Data

Oct. 7, 1987 [JP] Japan ..... 62-251674

[51] Int. Cl.[4] ..... H01J 29/70; H01J 29/76

[52] U.S. Cl. ..... 315/368

[58] Field of Search ..... 315/368; 335/213, 212; 313/412

[56] References Cited

U.S. PATENT DOCUMENTS 4,704,564 11/1987 Ito et al. ..... 315/368

4,725,763 2/1988 Okuyama et al. ..... 315/368

*Primary Examiner*—Theodore M. Blum

*Attorney, Agent, or Firm*—Antonelli, Terry & Wands

[57] ABSTRACT

Subcoils are provided on the core portion that serves as a deflection yoke, and a current for correcting convergence is supplied to the subcoils to correct convergence. Further, means is provided to suppress harmful current that is produced by mutual induction between the subcoils and the deflection coils, and whereby the deflection of electron beam and the correction of convergence are effected independently of each other.

12 Claims, 9 Drawing Sheets

ELECTRON BEAM DEFLECTOR

BACKGROUND OF THE INVENTION

The present invention relates to an electron beam deflector used for a cathode ray tube. More specifically, the invention relates to an electron beam deflector, equipped, in addition to a deflection coil, with a deflection yoke having subcoils for correcting convergence or having subcoils for correcting distortion of figure.

Japanese Patent Laid-Open No. 21053/1982 discloses a deflector that can be adapted to a cathode ray tube that has heretofore been used as a projection tube. According to the deflector of this prior art, coils are arranged in the order of deflection yoke and convergence yoke from the side of the phosphor screen, each of the yokes being independent from each other. The deflection yoke generates a main deflection magnetic field for deflecting the beam, and its output terminals are connected to a deflection output circuit.

The convergence yoke generates a correcting magnetic field such that red, green and blue electron beams come into agreement with each other on the screen. As a result, very small distortion of the figure is corrected. The terminal of the convergence yoke is connected to a convergence adjusting circuit. The above-mentioned structure has now been widely used as a deflector for the projection TV's.

With the above-mentioned conventional structure in which the deflection yoke and the convergence yoke are separated from each other, however, the total length of the cathode ray tube inevitably becomes long, imposing limitation in designing TV sets in compact sizes. When the electron gun has a high magnification, furthermore, problem arises in regard to focusing performance.

Another conventional example for solving this problem has been taught in Japanese Patent Laid-Open No. 198642/1984. According to this conventional example, the vertical subcoil is wound maintaining the same distribution as the vertical deflection coil. In this conventional example, however, no attention has been given in regard to winding the horizontal convergence coil (horizontal subcoil) maintaining the same distribution. Therefore, the deflector for the projection TV which includes horizontal and vertical convergence coils is not helpful for sufficiently reducing the total length of the cathode ray tube.

According to the prior art, therefore, the cathode ray tube has an extended total length due to the presence of convergence yoke. Therefore, limitation is imposed on reducing the size of the cathode ray tube, and satisfactory performance is not obtained for focusing the electron beam. According to the prior art, furthermore, disadvantage is also involved in regard to manufacturing cost.

SUMMARY OF THE INVENTION

The object of the present invention is to provide an electronic beam deflector in which the cathode ray tube has a decreased total length.

According to the present invention, main deflection coils for deflecting the beam in a horizontal direction or in a vertical direction and subcoils for adjusting the convergence (for correcting the distortion of figure) are wound on the same core, and the deflection yoke is constituted by the main deflection coils and by the subcoils. The present invention further has a transformer which, when a horizontal deflection current flows into the horizontal main deflection coils, generates a horizontal pulse voltage of a reverse sign to cancel the undersired horizontal pulse voltage induced in the horizontal subcoil that is one of the abovementioned subcoils, and further has a low-pass filter which, when a current for adjusting the convergence flows into the vertical subcoil which is another subcoil, suppresses an undersired current that is induced in the vertical deflection coils.

According to the present invention, the subcoils for generating the convergence magnetic field (magnetic field for correcting the distortion of figure) are wound on the same core as that of the deflection coils, and there is no need of providing the convergence yoke that was used in the conventional art.

Therefore, the total length of the cathode ray tube can be shortened. This fact makes it possible to reduce the size of the electron beam deflector and to improve the focusing performance of the electron beam.

DESCRIPTION OF THE PREFERRED EMBODIMENTS

Figure 1:
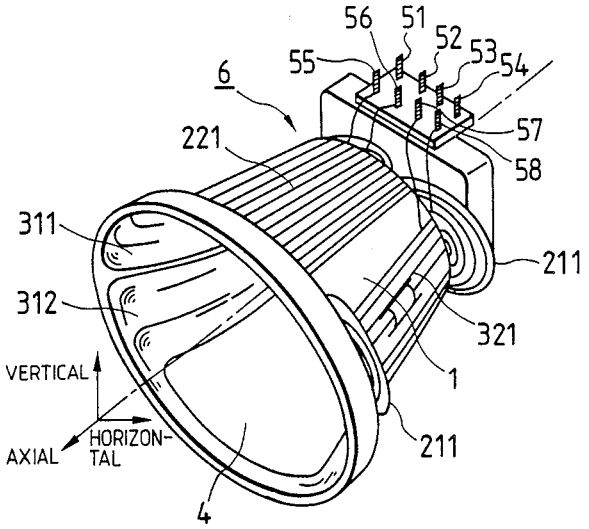
FIG. 1 is a perspective view illustrating a deflection yoke according to an embodiment of the present invention.

The deflection yoke shown in FIGS. 1 to 3 will now be described. Vertical deflection coils 211, 212 and horizontal deflection coils 311, 312 are wound in the form of a saddle and are arranged on the inside of an annular magnetic core 1. Vertical subcoils 221 and 222 and horizontal subcoils 321 and 322 are wound on the core 1 in a toroidal shape on the core 1. The vertical deflection coils 211, 212, vertical subcoils 221, 222 and horizontal subcoils 321, 322 are arranged being separated via a molding material 4 (made of an insulating material) from the horizontal deflection coils 311 and 312 that generate high voltages.

Figure 3:
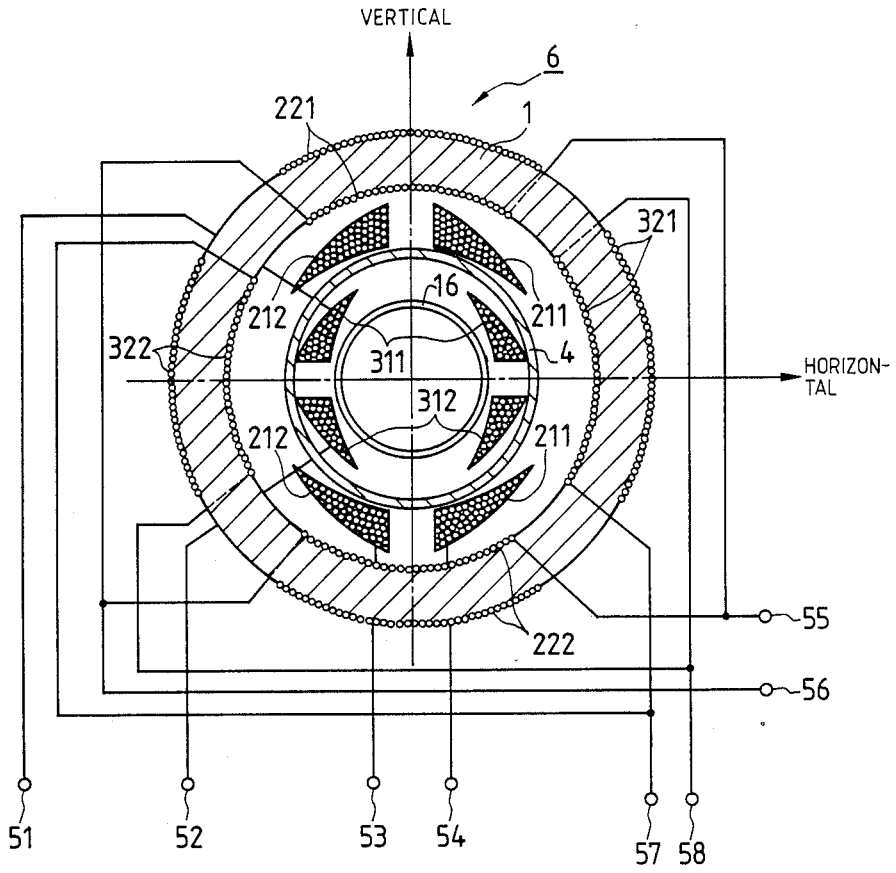
FIG. 3 is a section view along the line A-A in FIG. 2.

With reference to FIG. 3, the vertical subcoils 221 and 222 are connected in parallel, and the horizontal subcoils 321 and 322 are connected in parallel. The vertical deflection coils 211 and 212 are connected to vertical deflection coil terminals 53 and 54, the horizontal deflection coils 311 and 312 are connected to horizontal deflection coil terminals 51 and 52, and the vertical subcoils 221 and 222 are connected to vertical subcoil terminals 55 and 56.

Figure 4A:
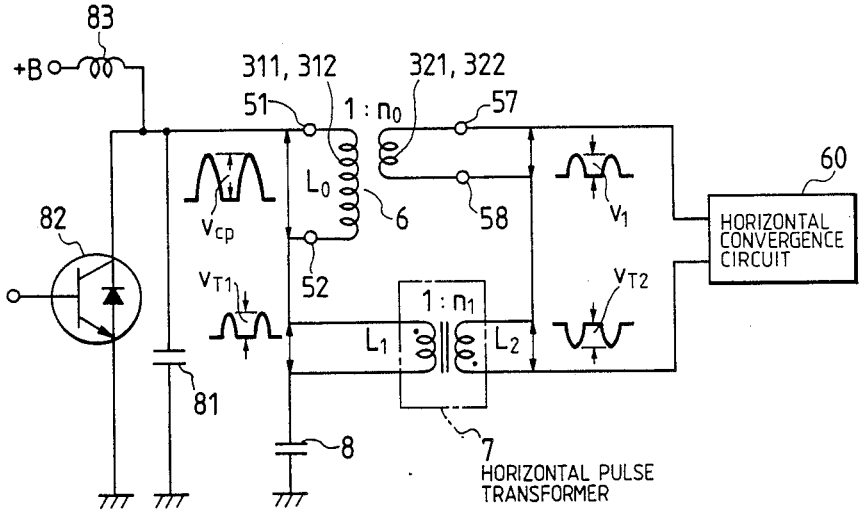
FIGS. 4*a* and 4*b* are circuit diagrams showing a drive circuit according to an embodiment of the present invention.
Figure 4B:
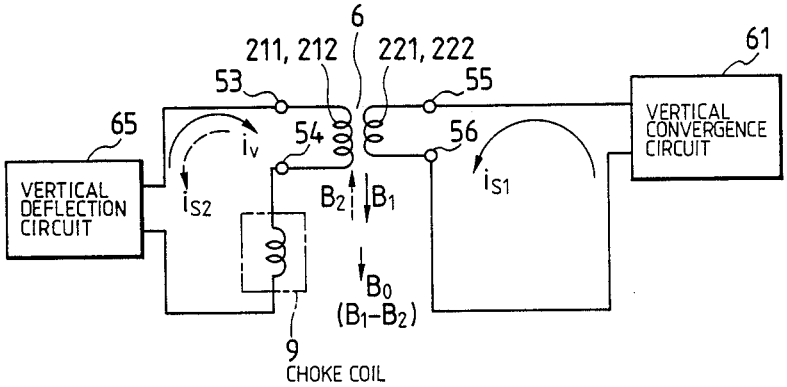

With reference to FIG. 4, the horizontal deflection coil terminal 51 is connected to the collector of a horizontal deflection output transistor 82 and the coil terminal 52 is connected to the primary side of a horizontal pulse transformer 7. Similarly, the horizontal subcoil terminal 57 is connected to a horizontal convergence circuit 60, and the coil terminal 58 is connected to the secondary side of the horizontal pulse transformer 7. Further, the vertical deflection coil terminal 53 is connected to a vertical deflection circuit 65, the coil terminal 54 is connected to a horizontal choke coil, and the vertical subcoil terminals 55 and 56 are connected to a vertical convergence circuit 61.

Operation of the embodiment will now be described. FIG. 4(*a*) is a diagram illustrating a horizontal drive circuit and FIG. 4(*b*) is a diagram illustrating a vertical drive circuit.

In FIG. 4(*a*), the horizontal output deflection circuit consists of a horizontal defection output transistor 82, a resonance capacitor 81, horizontal deflection coils 311 and 312, primary coil of the horizontal pulse transformer 7, and an S-character capacitor 8. The horizontal output deflection circuit supplies a horizontal deflection current to the horizontal deflection coils 311 and 312 to generate a horizontally deflected magnetic field. At the same time, a horizontal pulse voltage $V_{cr}$ of about 1 KV usually generates across the horizontal deflection coil terminals 51 and 52. Similarly, a horizontal pulse voltage $V_{T1}$ also generates on the primary side of the horizontal pulse transformer 7.

Figure 2:
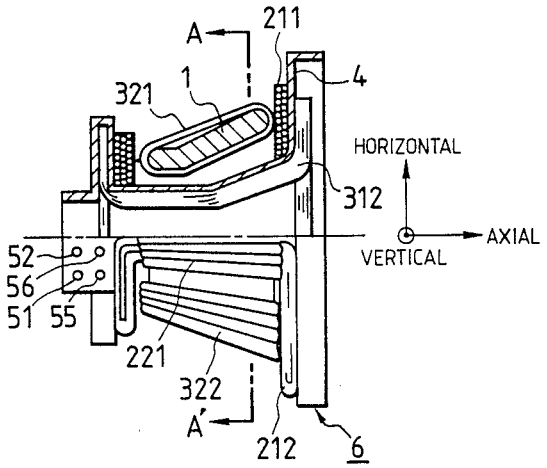
FIG. 2 is a half section view illustrating the embodiment of FIG. 1 as viewed from the upper direction.

The deflection yoke of the present invention shown in FIGS. 1 to 3 have horizontal deflection coils 311 and 312 as well as horizontal subcoils 321 and 322 that are wound on the same core 1. Therefore, the action of mutual induction develops between the horizontal deflection coils 311, 312 and the horizontal subcoils 321, 322 as shown in FIG. 4(*a*), and the above-mentioned horizontal pulse voltage $V_1$ is induced across the horizontal subcoil terminals 57 and 58. The horizontal convergence circuit 60 generates a current for correcting the convergence, supplies this current to the horizontal subcoils 321 and 322 to generate magnetic fields for correcting the convergence. Here, if the horizontal pulse voltage $V_1$ that is induced in the horizontal subcoils is input to the horizontal convergence circuit 60, the output transistor (not shown) in the circuit 60 may be destroyed. It is therefore necessary to so construct the circuit that the horizontal pulse voltage $V_1$ is offset and is not input to the horizontal convergence circuit 60.

The horizontal pulse transformer 7 works to offset the horizontal pulse voltage $V_1$.

That is, the circuit is so constituted that a horizontal pulse voltage $V_{T2}$ is generated on the secondary coil of the horizontal pulse transformer 7 having a phase opposite to that of the horizontal pulse voltage $V_1$ induced across the horizontal subcoil terminals 57 and 58. In this circuit structure, the following relationship (1) is satisfied, i.e., $$V_1 \simeq V_{T2} \tag{1}$$

Further, if an inductance between the horizontal deflection coil terminals 51 and 52 is $L_O$ and a turn ratio of the horizontal pulse transformer 7 is $n_1$, then the following relationship holds true, i.e., $$V_{T1} = \frac{L_1}{L_0 + L_1} \cdot V_{CP} \tag{2}$$

$$V_{T2} = -n_1 \cdot V_{T1}$$

If the equation (2) is substituted for the equation (1), then the following equation is obtained, $$V_1 \simeq n_1 \cdot \frac{L_1}{L_0 + L_1} \cdot V_{CP} \tag{3}$$

That is, if the equation (3) holds true, then the equation (1) holds true.

Namely, if the horizontal pulse transformer 7 is so constituted that the equation (3) holds true, then the horizontal pulse voltage $V_1$ induced between the horizontal subcoil terminals 57 and 58 is suppressed by the inverse horizontal pulse voltage $V_{T2}$ generated on the secondary side of the horizontal pulse transformer 7, and no horizontal pulse voltage appears across the terminals of the horizontal convergence circuit. By using the drive circuit shown in FIG. 4(*a*), therefore, operation of the horizontal convergence circuit is not adversely affected at all, and the horizontal convergence is corrected.

With the horizontal pulse transformer 7 being contained in the drive circuit, furthermore, the electric power is consumed in large amounts by the horizontal deflection output circuit and by the horizontal convergence circuit 60. Therefore, the primary and secondary sides of the horizontal pulse transformer 7 should have inductances $L_1$ and $L_2$ that are as small as possible. For this purpose, the turn ratio $n_O$ or the coupling coefficient should be maintained small between the horizontal deflection coils 311, 312 and the horizontal subcoils 321, 322, or the horizontal subcoils 321 and 322 should be connected in parallel such that a small horizontal pulse voltage $V_1$ is induced.

Next, the vertical drive circuit shown in FIG. 4(*b*) will be described. In FIG. 4(*b*), a vertical deflection current $i_v$ generated by a vertical deflection circuit 65 flows into the vertical deflection coils 211 and 212 to produce a vertically deflected magnetic field. A convergence correction current $i_s$ produced by the vertical convergence circuit flows into the vertical subcoils 221 and 222 to generate a magnetic field $B_1$ for correcting the vertical convergence. The current $i_v$ produced by the vertical deflection circuit 65 has a sawtooth wave form with a period same as the vertical period. However, the current produced by the vertical convergence circuit 61 usually has a parabolic wave form with a period same as the vertical period on which are superposed a sawtooth wave form and a parabolic wave form of a horizontal period, and has a frequency component which is greater than the vertical period.

Figure 5:
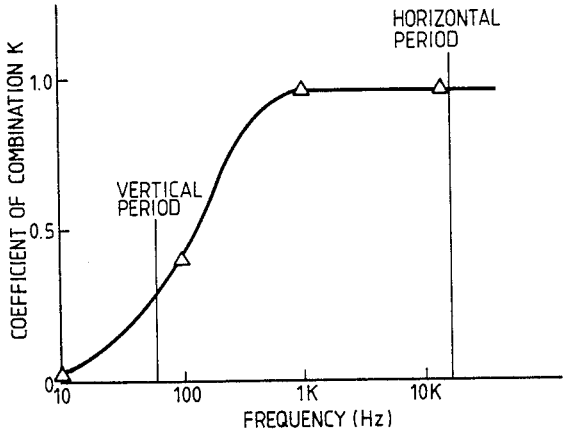
FIG. 5 is a graph illustrating coupling coefficient characteristics of vertical deflection coils and vertical subcoils.

FIG. 5 shows measured characteristics of the coupling coefficient between the vertical deflection coils 211, 212 and the vertical subcoils 221, 222 shown in FIGS. 3 and 4(*b*) relative to the frequency. The characteristics of FIG. 5 indicate the result that is described below. Namely, the coupling coefficient at a vertical deflection frequency is small but is nearly 1.0 at frequencies greater than a horizontal deflection frequency. Therefore, among the currents generated by the vertical convergence circuit 61 of FIG. 4(*b*), the current having a frequency greater than the horizontal deflection frequency induces a current $i_{s2}$ in the vertical deflection coils 211 and 212 due to the action of mutual induction. Due to this current $i_{s2}$, the vertical deflection coils 211 and 212 generate a magnetic field $B_2$ in a direction opposite to that of the magnetic field $B_1$. If the current $i_{s2}$ is induced, therefore, the effective magnetic field $B_1$ for correcting the vertical convergence is offset, and the magnetic field decreases to $B_O$ $(=B_1-B_2)$. To prevent this phenomenon from occurring, a horizontal choke coil 9 is connected.

Figure 6:
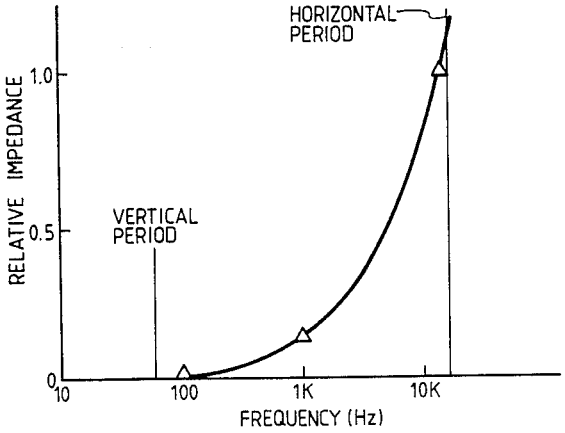
FIG. 6 is a graph showing characteristics of a low-pass filter that is used in the present invention.

FIG. 6 shows impedance characteristics of the horizontal choke coil 9 for the frequency. The horizontal choke coil 9 exhibits impedance which is nearly zero at the vertical deflection frequency and which increases greatly as the frequency becomes greater than the horizontal deflection frequency. Therefore, among the currents produced by the vertical convergence circuit 61, a current $i_{s2}$ induced by a current of a frequency higher than the horizontal deflection frequency is blocked by the horizontal choke coil 9. Therefore, the induction current $i_{s2}$ is nearly zero and the magnetic field $B_2$ is produced very little $i_v$ this embodiment $(B_2=0)$. The vertical deflection current iv, on the other hand, is not blocked by the horizontal choke coil 9.

According to this embodiment in which the horizontal choke coil 9 is connected in series with the vertical deflection coils 211 and 212, as described above, there arises no hindrance that results from the mutual induction between the vertical subcoils 221, 222 and the vertical deflection coils 211, 212. The coupling coefficient (FIG. 5) between the vertical deflection coils 211, 212 and the vertical subcoils 221, 222 should be as small as possible at the vertical deflection frequency. For this purpose according to this embodiment, the vertical deflection coils 211 and 212 are wound in the form of a saddle, and the vertical subcoils 221 and 222 are wound in a toroidal form. The vertical deflection coils 211, 212 and the vertical subcoils 221, 222 that are wound in different directions as done in this embodiment, contribute to decreasing the coupling coefficient between the coils. The coupling coefficient can be maintained small between the coils even when the vertical deflection coils 211, 212 are wound in a toroidal form and the vertical subcoils 221, 222 are wound in a saddle form contrary to that of the above-mentioned embodiment.

Figure 7A:
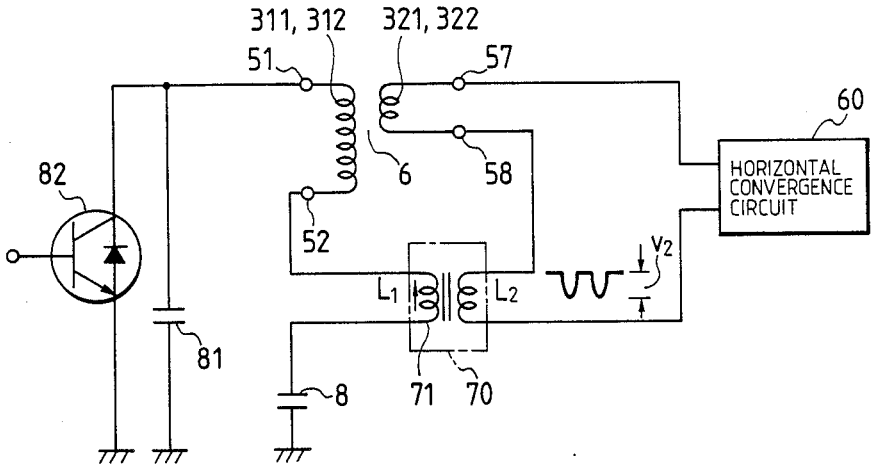
FIGS. 7*a* and 7*b* are circuit diagrams illustrating the drive circuit according to another embodiment of the present invention.
Figure 7B:
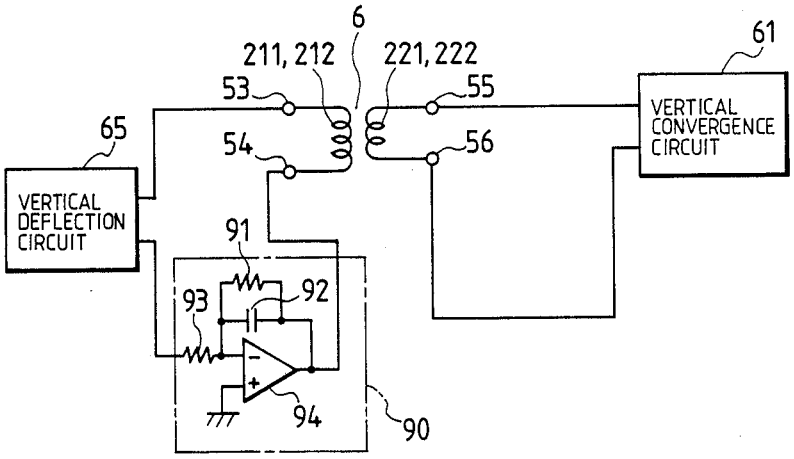

FIG. 7 illustrates another embodiment of the drive circuit of the present invention, wherein the same portions as those of the embodiment of FIG. 4 are denoted by the same reference numerals. In the horizontal drive circuit shown in FIG. 7(*a*), a horizontal pulse transformer 70 is constituted by winding a secondary coil on a horizontal size coil 71 (in which the core moves up and down to vary the inductance) that is an accessory to the horizontal deflection coils 311 and 312.

In the vertical drive circuit shown in FIG. 7(*b*), a low-pass filter circuit 90 consisting of a resistor 91, a capacitor 92, a resistor 93 and an amplifier 94 is connected in series with the vertical deflection coils 211 and 212. The low-pass filter circuit 90 has impedance characteristics that are shown in FIG. 6.

The embodiment shown in FIG. 7 exhibits the same effects as those of the embodiment shown in FIG. 4. In the embodiment shown in FIG. 7(*a*), the horizontal size coil 71 is also utilized for the horizontal pulse transformer 70. In the embodiment shown in FIG. 4(*a*), for example, the horizontal deflection coils 311 and 312 are further provided with a horizontal size coil. Usually, the inductance of the horizontal size coil is adjusted to correct variance in the inductance of the horizontal deflection coils. In the embodiment of FIG. 7(*a*), the primary coil of the horizontal pulse transformer 70 also serves as the horizontal size coil 71, whereby the number of the coils is reduced by one and the load of the horizontal deflection output circuit is reduced, too.

Figure 8:
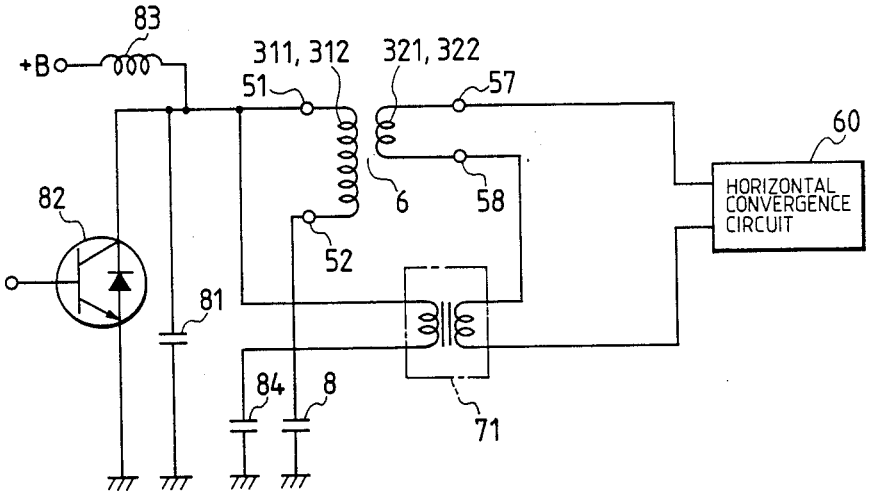
FIG. 8 is a circuit diagram illustrating the drive circuit according to a further embodiment of the present invention.

FIG. 8 is a diagram illustrating a further embodiment of the present invention, wherein the same portions as those of the circuit of FIG. 4(*a*) are denoted by the same reference numerals. The greatest feature of the embodiment shown in FIG. 8 is that one end of the primary coil of the horizontal pulse transformer 71 is connected to the collector of a horizontal output transistor 82, and the other end thereof is connected to a capacitor 84. The embodiment of FIG. 8 operates in the same manner as the embodiment of FIG. 4(*a*).

Figure 9:
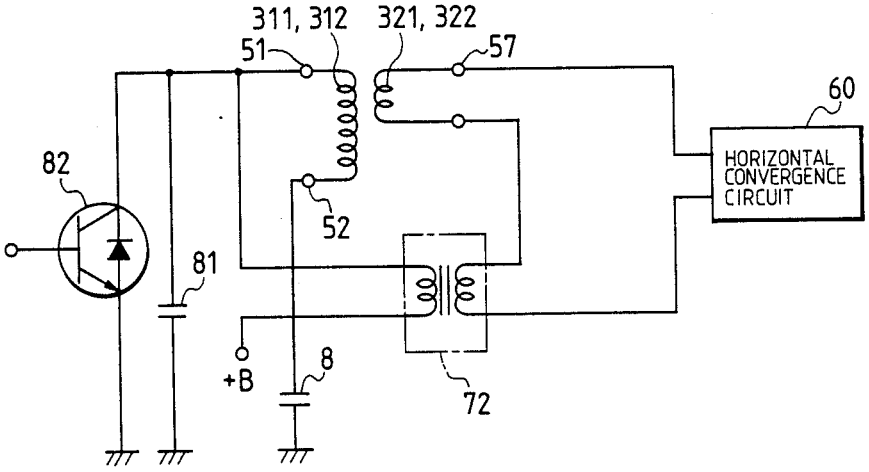
FIG. 9 is a circuit diagram illustrating the drive circuit according to a still further embodiment of the present invention.

FIG. 9 is a diagram which illustrates a still further embodiment of the present invention, and wherein the same portions as those of the circuit of FIG. 4(*a*) are denoted by the same reference numerals. The great feature of the embodiment of FIG. 9 is that one end of the primary coil of the horizontal pulse transformer 71 is connected to the collector of the horizontal output transistor 82, and the other end thereof is connected to a power source +B. The embodiment shown in FIG. 9 operates in the same manner as the embodiment of FIG. 4(*a*).

Figure 10A:
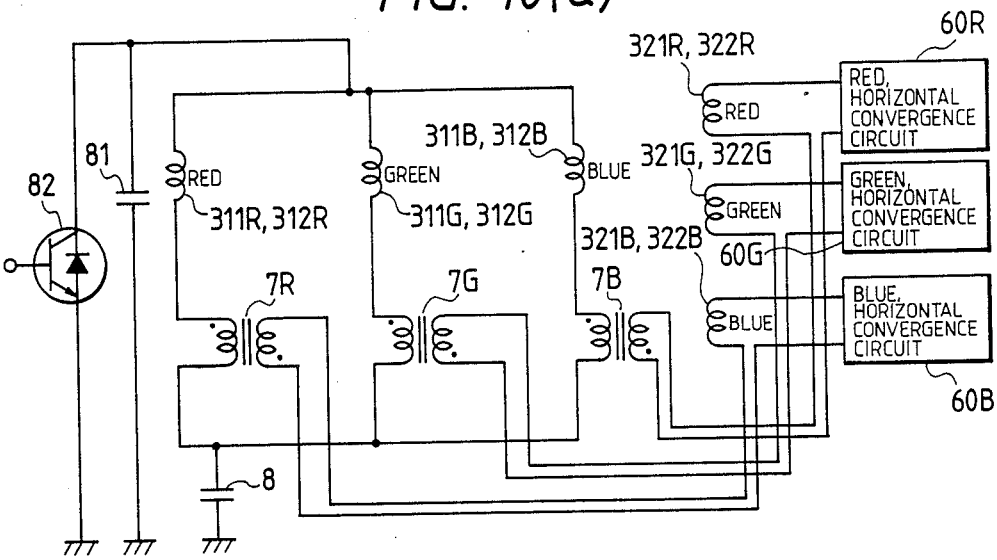
FIGS. 10*a* and 10*b* are circuit diagrams illustrating the drive circuit according to a yet further embodiment of the present invention.
Figure 10B:
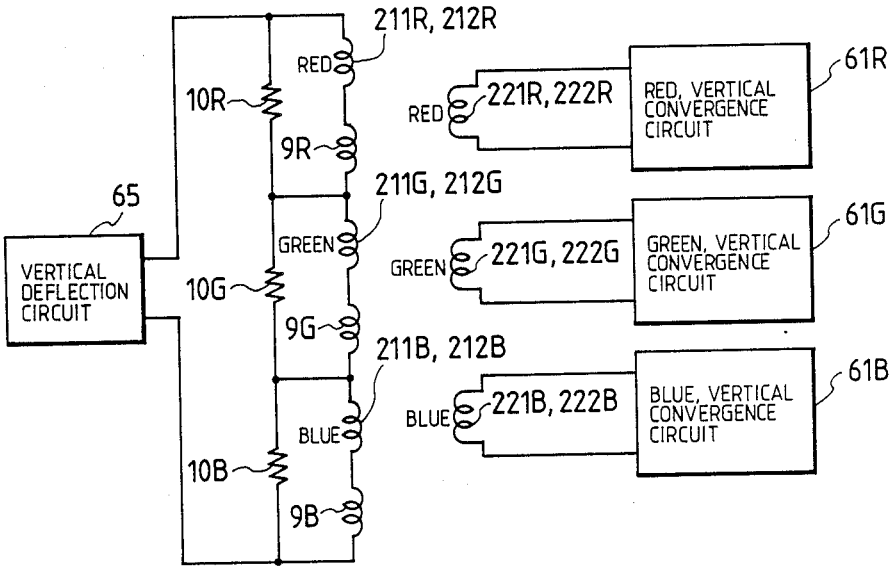

FIG. 10 is a diagram illustrating the drive circuit according to a yet further embodiment of the present invention. The embodiment of FIG. 10 stands for the case where the present invention is adapted to the deflection yoke of the projection TV that employs three cathode ray tubes, i.e., a cathode ray tube for red (R), a cathode ray tube for green (G) and a cathode ray tube for blue (B). In the embodiment shown in FIG. 10, the elements same as those of the embodiments of FIGS. 1 to 4 are denoted by the same reference numerals. The embodiment shown in FIG. 10 will now be described. FIG. 10(*a*) illustrates a horizontal drive circuit, and FIG. 10(*b*) illustrates a vertical drive circuit In the horizontal drive circuit shown in FIG. 10(*a*), horizontal deflection coils 311R, 312R for red (R), horizontal deflection coils 311G, 312G for green (G), and horizontal deflection coils 311B, 312B for blue (B) are connected in parallel with each other. In the vertical drive circuit shown in FIG. 10(*b*), furthermore, vertical deflection coils 211R, 212R for red (R), vertical deflection coils 211G, 212G for green (G), and vertical deflection coils 211B, 212B for blue (B) are connected in series with each other The horizontal deflection coils 311R, 312R for red (R), horizontal subcoils 321R, 322R, vertical deflection coils 211R, 212R and vertical subcoils 221R, 222R are constructed in the same manner as those of the embodiments shown in FIGS. 1 to 3. The drive circuit for red (R) has the same circuit structure as the drive circuit shown in FIG. 4, and operates in the same manner as that of the embodiments shown in FIGS. 1 to 4.

Furthermore, the coils 311G, 312G, 321G, 322G, 211G, 212G, 221G and 222G for green (G) as well as the drive circuit for green (G) are also constructed in the same manner as those of the embodiments shown in FIGS. 1 to 4, and operate in the same manner. The same also holds true for the coils 311B, 312B, 321B, 322B, 211B, 212B, 221B, 222B for blue (B) and the drive circuit for blue (B). That is, the embodiment shown in FIG. 10 employs any one of embodiments of FIGS. 1 to 4 in three sets for red (R), green (G) and blue (B).

According to the embodiment shown in FIG. 10, the action of mutual induction is nearly completely suppressed among the vertical deflection coils 211, 212, vertical subcoils 221, 222, horizontal deflection coils 311, 312 and horizontal subcoils 321, 322 of red (R), green (G) and blue (B), and horizontal convergence and vertical convergence of cathode ray tubes for red, green and blue are adjusted independently from each other.

Figure 11:
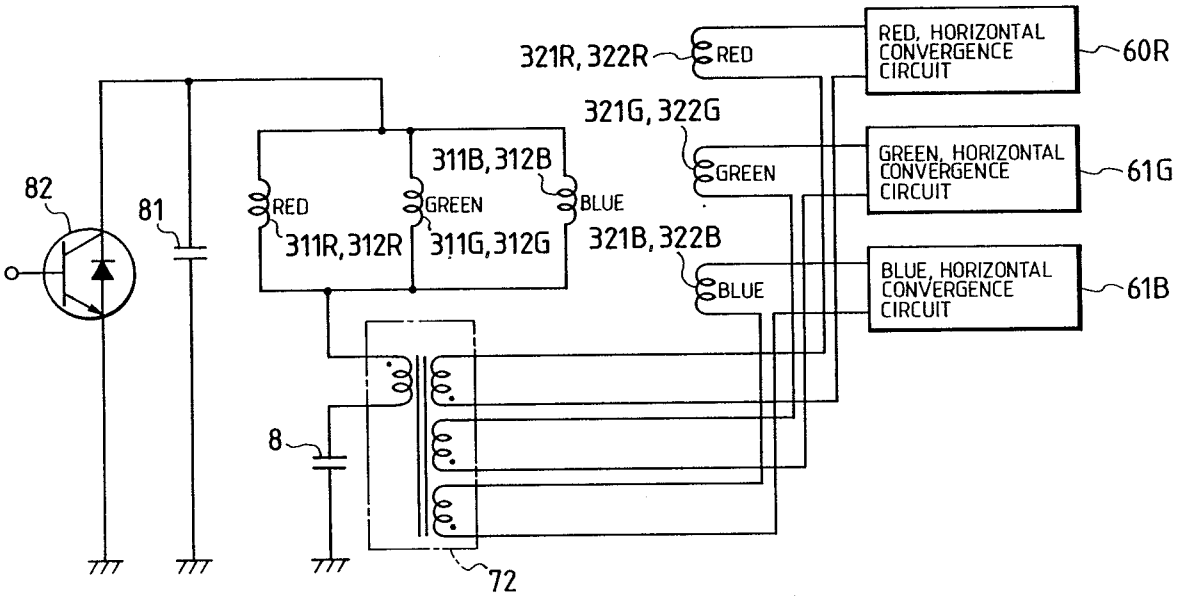
FIG. 11 is a circuit diagram illustrating the drive circuit according to another embodiment of the present invention.

FIG. 11 illustrates another embodiment of the drive circuit for the horizontal deflection system according to the present invention. Like the embodiment of FIG. 10, the embodiment shown in FIG. 11 represents the case where the present invention is adapted to the deflection yoke of a projection TV having three cathode ray tubes, i.e., having a cathode ray tube for red (R), a cathode ray tube for green (G) and a cathode ray tube for blue (B). The embodiment shown in FIG. 11 is the same as the embodiment shown in FIG. 10(*a*) except that the structure of the horizontal pulse transformer 72 is different from that of the embodiment of FIG. 10(*a*). In the embodiment of FIG. 11, the horizontal pulse transformer 7R for red (R), horizontal pulse transformer 7G for green (G) and horizontal pulse transformer 7B for blue (B) are replaced by a single horizontal pulse transformer 72 that operates like these transformers. The circuit of FIG. 11 operates in the same manner as the circuit of FIG. 10, and the horizontal convergence and vertical convergence of red, green and blue cathode ray tubes can be independently adjusted like those of the embodiment of FIG. 10.

Figure 12:
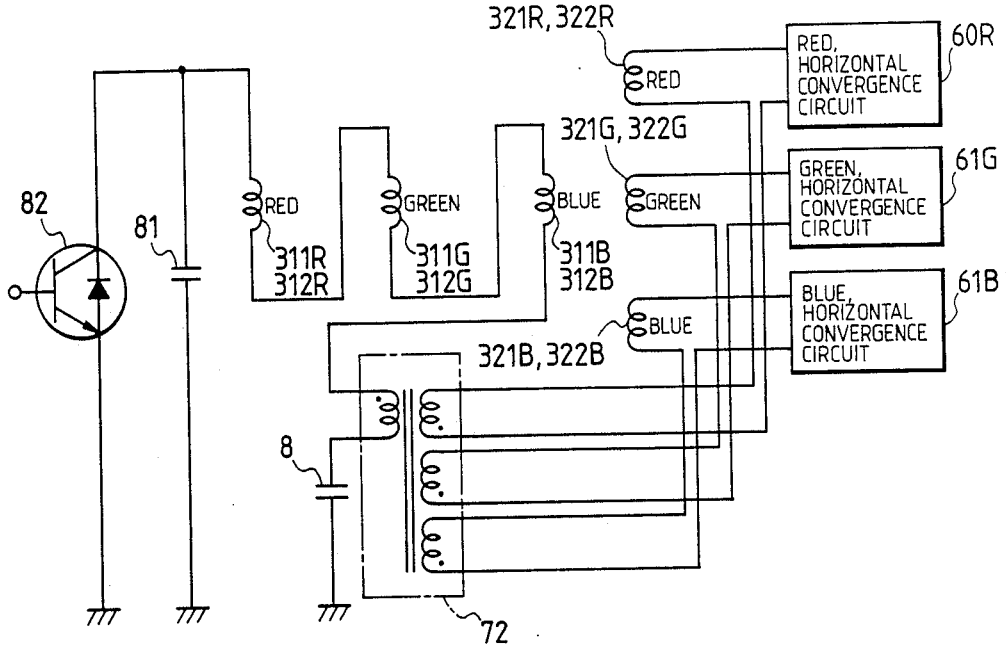
FIG. 12 is a circuit diagram illustrating the drive circuit according to a further embodiment of the present invention.

FIG. 12 illustrates a further embodiment of the drive circuit for the horizontal deflection system according to the present invention. Like the embodiment shown in FIG. 10, the embodiment of FIG. 12 represents the case where the present invention is applied to the deflection yoke of a projection TV having three cathode ray tubes, i.e., having a cathode ray tube for red (R), a cathode ray tube for green (G) and a cathode ray tube for blue (B). The embodiment shown in FIG. 12 is the same as the embodiment of FIG. 11 except that horizontal deflection coils 311R, 312R for red (R), horizontal deflection coils 311G, 312G for green (G), and horizontal deflection coils 311B, 312B for blue (B) are connected in series unlike those of the embodiment of FIG. 11. In the embodiment of FIG. 12, the horizontal pulse transformer 7R for red (R), horizontal pulse transformer 7G for green (G) and horizontal pulse transformer 7B for blue (B) of FIG. 10(*a*)are replaced by a single horizontal pulse transformer 72 that operates like these transformers, and these horizontal deflection coils are connected in series. The circuit shown in FIG. 12 operates like the circuit of FIG. 10, permitting the horizontal convergence and vertical convergence of the red, green and blue cathode ray tubes to be adjusted independently of each other like in the embodiment of FIG. 10.

Figure 13:
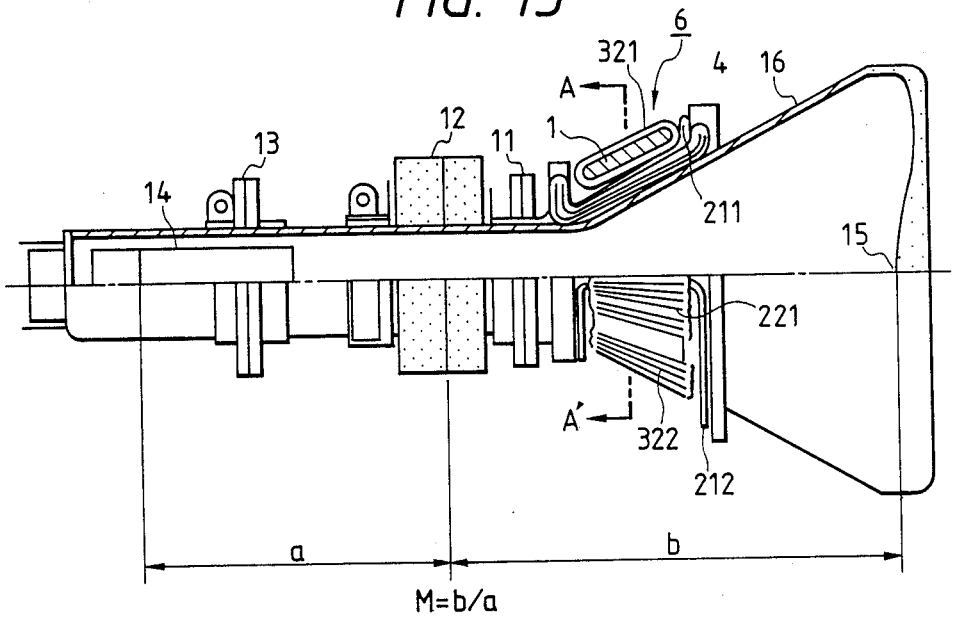
FIG. 13 is a half sectional side view of a cathode ray tube to which the present invention is applied.

FIG. 13 is a half section view illustrating the case where the deflection yoke 6 of the present invention is applied to a magnetic field focusing cathode ray tube.

In FIG. 13, reference numeral 11 denotes a centering magnet, 12 denotes a focusing magnet, 13 denotes a beam alignment magnet, 14 denotes an electron gun, 15 denotes a phosphor screen, 16 denotes a funnel, a denotes a distance from the crossover position of the electron gun to the central portion of the focusing magnet 12, and b denotes a distance from the central portion of the focusing magnet 12 to the phosphor screen.

According to the prior art, the deflection yoke 6 is not provided with subcoils 221, 222, 321, 322, but a convergence yoke is disposed between the centering magnet 11 and the focusing magnet 12.

According to this embodiment, however, no convergence yoke is needed, and the focusing magnet 12 is arranged at a position which is closer to the phosphor screen by 2 to 3 cm than that of the prior art. This enables the focusing magnification M (=b/a) to be decreased by 15 to 30% and the focusing performance to be improved by 10 to 25%.

In addition to that the focusing magnet 12 is located closer to the phosphor screen by about 2 to 3 cm, the total length of the cathode ray tube may also be shortened by 2 to 3 cm (in this case, the distance a remains unchanged but the distance b is shortened by about 2 to 3 cm). In this case, the focusing performance is improved and, at the same time, the total length of the cathode ray tube is shortened.

We claim:

1. An electron beam deflector comprising:

a deflection yoke having an annular magnetic core, horizontal deflection coils arranged inside said magnetic core to generate a magnetic field for deflecting the electron beam in a horizontal direction, vertical deflection coils arranged inside said magnetic core to generate a magnetic field for deflecting the electron beam in a vertical direction, horizontal subcoils and vertical subcoils wound on said annular magnetic core to generate magnetic fields for adjusting the convergence;

a horizontal deflection circuit for supplying a horizontal deflection current to said horizontal deflection coils;

a vertical deflection circuit for supplying a vertical deflection current to said vertical deflection coils;

a horizontal convergence circuit for supplying a current for correcting horizontal convergence to said horizontal subcoils;

a vertical convergence circuit for supplying a current for correcting vertical convergence to said vertical subcoils;

a horizontal pulse transformer having a primary coil that is connected in series with said horizontal deflection coils and a secondary coil that is connected in series with said horizontal subcoils, wherein a current that flows into the primary coil induces a pulse voltage on the secondary coil, the pulse voltage having a polarity opposite to that of a horizontal pulse voltage that is induced on said subcoils due to a current that flows into said horizontal deflection coils; and a low-pass filter which is connected in series with said vertical deflection coils, which permits a current of a vertical deflection frequency to pass through but which suppresses a current having a frequency higher than a horizontal deflection frequency.

2. An electron beam deflector comprising:

a deflection yoke having an annular magnetic core, horizontal deflection coils arranged inside said magnetic core to generate a magnetic field for deflecting the electron beam in a horizontal direction, vertical deflection coils arranged inside said magnetic core to generate a magnetic field for deflecting the electron beam in a vertical direction, horizontal subcoils and vertical subcoils wound on said annular magnetic core to generate magnetic fields for adjusting the convergence;

a horizontal deflection circuit for supplying a horizontal deflection current to said horizontal deflection coils;

a vertical deflection circuit for supplying a vertical deflection current to said vertical deflection coils;

a horizontal convergence circuit for supplying a current for correcting horizontal convergence to said horizontal subcoils;

a vertical convergence circuit for supplying a current for correcting vertical convergence to said vertical subcoils;

a horizontal pulse transformer having a primary coil that is connected in parallel with said horizontal deflection coils and a secondary coil that is connected in series with said horizontal subcoils, wherein a current that flows into the primary coil induces a pulse voltage on the secondary coil, the pulse voltage having a polarity opposite to that of a horizontal pulse voltage that is induced on said subcoils due to a current that flows into said horizontal deflection coils; and a low-pass filter which is connected in series with said vertical deflection coils, which permits a current of a vertical deflection frequency to pass through but which suppresses a current having a frequency higher than a horizontal deflection frequency.

3. An electron beam deflector according to claim 1, wherein said low-pass filter consists of a choke coil.

4. An electron beam deflector according to claim 2, wherein said low-pass filter consists of a choke coil.

5. An electron beam deflector according to claim 1, wherein said horizontal pulse transformer has a primary coil that consists of a horizontal size coil connected in series with the horizontal deflection coils and a secondary coil that is wound to surround the horizontal size coil.

6. An electron beam deflector according to claim 2, wherein said horizontal pulse transformer has a primary coil that consists of a horizontal size coil connected in series with the horizontal deflection coils and a secondary coil that is wound to surround the horizontal size coil.

7. An electron beam deflector according to claim 3, wherein said horizontal pulse transformer has a primary coil that consists of a horizontal size coil connected in series with the horizontal deflection coils and a secondary coil that is wound to surround the horizontal size coil.

8. An electron beam deflector according to claim 4, wherein said horizontal pulse transformer has a primary coil that consists of a horizontal size coil connected in series with the horizontal deflection coils and a secondary coil that is wound to surround the horizontal size coil.

9. An electron beam deflector according to claim 1, wherein said low-pass filter comprises a differential amplifier whose input terminal of positive polarity is grounded, a first resistor connected to an input terminal of negative polarity of said differential amplifier, a capacitor connected between the input terminal of negative polarity and the output terminal of said differential amplifier, and a second resistor connected in parallel with said capacitor.

10. An electron beam deflector according to claim 5, wherein said low-pass filter comprises a differential amplifier whose input terminal of positive polarity is grounded, a first resistor connected to an input terminal of negative polarity of said differential amplifier, a capacitor connected between the input terminal of negative polarity and the output terminal of said differential amplifier, and a second resistor connected in parallel with said capacitor.

11. An electron beam deflector comprising:

three deflection yokes each having an annular magnetic core, horizontal deflection coils arranged inside said magnetic core to generate a magnetic field for deflecting the electron beam in a horizontal direction, vertical deflection coils arranged inside said magnetic core to generate a magnetic field for deflecting the electron beam in a vertical direction, horizontal subcoils and vertical subcoils wound on said annular magnetic core to generate magnetic fields for adjusting the convergence, said horizontal deflection coils of each of the deflection yokes being connected in parallel and said vertical deflection coils of each of the deflection yokes being connected in series;

a horizontal deflection circuit for supplying a horizontal deflection current to said horizontal deflection coils of said three deflection yokes that are connected in parallel;

a vertical deflection circuit for supplying a vertical deflection current to said vertical deflection coils of said three deflection yokes that are connected in series;

three horizontal convergence circuits for supplying currents for correcting horizontal convergence to said horizontal subcoils of said three deflection yokes;

three vertical convergence circuits for supplying currents for correcting vertical convergence to said vertical subcoils of said three deflection yokes;

a horizontal pulse transformer having a primary coil that is connected in series with said horizontal deflection coils and three secondary coils that are connected in series with said horizontal subcoils of said three deflection yokes, wherein a current that flows into the primary coil induces a pulse voltage on the secondary coils, the pulse voltage having a polarity opposite to that of a horizontal pulse voltage that is induced on said subcoils due to a current that flows into said horizontal deflection coils; and three low-pass filters which are connected in series with the vertical deflection coils of said three deflection yokes, which permit a current of a vertical deflection frequency to pass through but which suppress a current having a frequency higher than a horizontal deflection frequency.

12. An electron beam deflector comprising:

three deflection yokes each having an annular magnetic core, horizontal deflection coils arranged inside said magnetic core to generate a magnetic field for deflecting the electron beam in a horizontal direction, vertical deflection coils arranged inside said magnetic core to generate a magnetic field for deflecting the electron beam in a vertical direction, horizontal subcoils and vertical subcoils wound on said annular magnetic core to generate magnetic fields for adjusting the convergence, said horizontal deflection coils of each of the deflection yokes being connected in series and said vertical deflection coils of each of the deflection yokes being connected in series;

a horizontal deflection circuit for supplying a horizontal deflection current to said horizontal deflection coils of said three deflection yokes that are connected in series;

a vertical deflection circuit for supplying a vertical deflection current to said vertical deflection coils of said three deflection yokes that are connected in series;

three horizontal convergence circuits for supplying currents for correcting horizontal convergence to said horizontal subcoils of said three deflection yokes;

three vertical convergence circuits for supplying currents for correcting vertical convergence to said vertical subcoils of said three deflection yokes;

a horizontal pulse transformer having a primary coil that is connected in series with said horizontal deflection coils and three secondary coils that are connected in series with said horizontal subcoils of said three deflection yokes, wherein a current that flows into the primary coil induces a pulse voltage on the secondary coils, the pulse voltage having a polarity opposite to that of a horizontal pulse voltage that is induced on said subcoils due to a current that flows into said horizontal deflection coils; and three low-pass filters which are connected in series with the vertical deflection coils of said three deflection yokes, which permit a current of a vertical deflection frequency to pass through but which suppresses a current having a frequency higher than a horizontal deflection frequency.

* * * * *